United States Patent [19]

Bostic, III et al.

[11] 4,423,625

[45] Jan. 3, 1984

[54] PRESSURE TRANSIENT METHOD OF RAPIDLY DETERMINING PERMEABILITY, THICKNESS AND SKIN EFFECT IN PRODUCING WELLS

[75] Inventors: James N. Bostic, III, Dallas, Tex.; Robert D. Carter, Tulsa, Okla.; Ram G. Agarwal, Tulsa, Okla.; Ronald F. Crowell, Jenks, Okla.

[73] Assignee: Standard Oil Company, Chicago, Ill.

[21] Appl. No.: 325,804

[22] Filed: Nov. 27, 1981

[51] Int. Cl.[3] ..... E21B 47/10

[52] U.S. Cl. ..... 73/155; 166/250

[58] Field of Search ..... 73/155; 364/422; 166/250

[56] References Cited

U.S. PATENT DOCUMENTS

| | | | |
|---|---|---|---|
| 2,158,569 | 5/1939 | Bowen | 73/155 |
| 3,478,584 | 11/1969 | Strubhar et al. | 166/250 |
| 3,550,445 | 12/1970 | Kiel | 73/155 |

*Primary Examiner*—Howard A. Birmiel

*Attorney, Agent, or Firm*—Scott H. Brown; Fred E. Hook

[57] ABSTRACT

A method of flow testing a producing formation through a well including lowering into the well a recording pressure and temperature device to measure pressure and temperature as functions of time, then lowering into the well a test chamber closed at the bottom by a surface activated valve. The space between the chamber and the top of the formation is sealed and immediately thereafter the pressure and temperature of the well is measured. The valve on the test chamber is opened to allow formation fluids to enter therein and the pressure and temperature is measured as a function of time for a substantial period of time during which the pressure in the chamber increases, whereby the flow capacity and skin factor of the formation can be calculated.

11 Claims, 5 Drawing Figures

PRESSURE TRANSIENT METHOD OF RAPIDLY DETERMINING PERMEABILITY, THICKNESS AND SKIN EFFECT IN PRODUCING WELLS

BACKGROUND OF THE INVENTION

1. Field of the Invention

The present invention relates to an improved process for testing a producing well to find static reservoir pressure and the variation of pressure with time from which the flow rate of fluids from the producing formation under tests can be established, then from these data determining the product of average formation permeability (k) times effective producing bed thickness (h), and the skin factor (s). While not so limited, it has particular application to the testing of gas formations of low average permeability, those capable of producing a flow rate of the order of 50 mcf/day of gas down to aproximately a tenth that value.

2. Setting of the Invention

In the past, two ways of determining the response of the reservoir formation in a well have been employed. Initially, in both cases, the well is ordinarily cased down to the producing formation and, in fact, may have been cased through the producing formation and perforated. Ordinarily it stands full of drilling fluid or water in order to control escape of valuable fluids from the producing formation. Into this well is lowered a string of tubing with an openable valve at the bottom. This valve is ultimately located essentially at the top of the producing formation. At the top of this string of tubing there is located a second valve which leads to a surface pressure measuring device, often a deadweight tester. There is also a bottomhole pressure measuring device, called a pressure bomb, which is either internal plotting (for example, the well-known Amerada type) or surface recording (for example, the Hewlett-Packard type).

Conventional testing is generally divided into three parts. The first part involves measurement of initial reservoir pressure by obtaining the pressure, using the bomb to determine bottomhole pressure before reservoir fluid is produced. This is followed by a three day flow test so reservoir fluid can flow to the surface for rate determination at a constant rate. The final portion of the conventional test is a six-day buildup test in which the well is once more shut-in and the bottomhole pressure recorded versus time, so that the formation flow capacity and skin effect can be determined.

It has been found that in low to moderate permeability gas wells it is necessary to shut the wells in at the bottom of the tubing string using, as mentioned above, some type of controllable tubing valve and preferably employing an expansible packer on the outside of the tubing to close the annulus at the top of the production formation. This second procedure is used instead of shutting in the well at the top, because in that case it takes much longer in low permeability wells to reduce the flow of fluid into the well to a sufficiently low value so the buildup pressure curve can be analyzed.

While these methods are used, better procedures were needed because (1) the measurement of fluid flow rates is notoriously poor at rates under 50 mcf/day, and (2) the total testing time required is too long, of the order of 6 to 10 days at least.

This invention utilizes a new pressure transient testing procedure quite different from (though, of course, related to) those used in the past. It could be termed a "limited volume wellbore transient test". The idea behind this limited volume test is to cause flow of formation fluid into a volume of known dimensions, and to measure the rate of pressure increase with time. This permits calculation of flow rates from knowledge of the properties of the fluid, the temperature of the gas, and the volume into which it is flowing. Then in calculating the formation flow capacity (Kh) one uses these data and the fluid viscosity. As in most modern technology, a computer program greatly speeds up the calculations involved in this system.

The major advantage of this testing procedure is that the total testing time is of the order of a half to a full day (i.e., of the order of 12 to 24 hours).

In order to distinguish more readily between this new procedure and conventional testing and analysis procedures, reference is made to a highly abbreviated bibliography consisting of the following publications:

Horner, D. R., "Pressure Build-Up in Wells", Proc. of 3rd World Petroleum Congress, Vol. 2, p. 503.

Van Everdingen, A. F., "The Skin Effect and Its Influence on the Productive Capacity of a Well", Trans. A.I.M.E. (1953), Vol. 198, pp 171–6.

Hurst, W., "Establishment of the Skin Effect and Its Impediment to Fluid Flow into a Well Bore", Pet. Engr. (October, 1953), Vol. 25, p. B-6.

Gladfelter, R. E., Tracy, G. W., and Wilsey, L. E., "Selective Wells which will Respond to Production-Stimulation Treatment", Drilling and Production Practices, A.P.I. (1955), p. 117 ff.

Agarwal, R. G., Carter, R. D., and Pollock, C. B., "Evaluation and Performance Prediction of Low-Permeability Gas Wells Stimulated by Massive Hydraulic Fracturing", J. Pet. Tech. (March 1979), pp. 362–372.

DETAILED DESCRIPTION OF THE DRAWINGS

Figure 1:
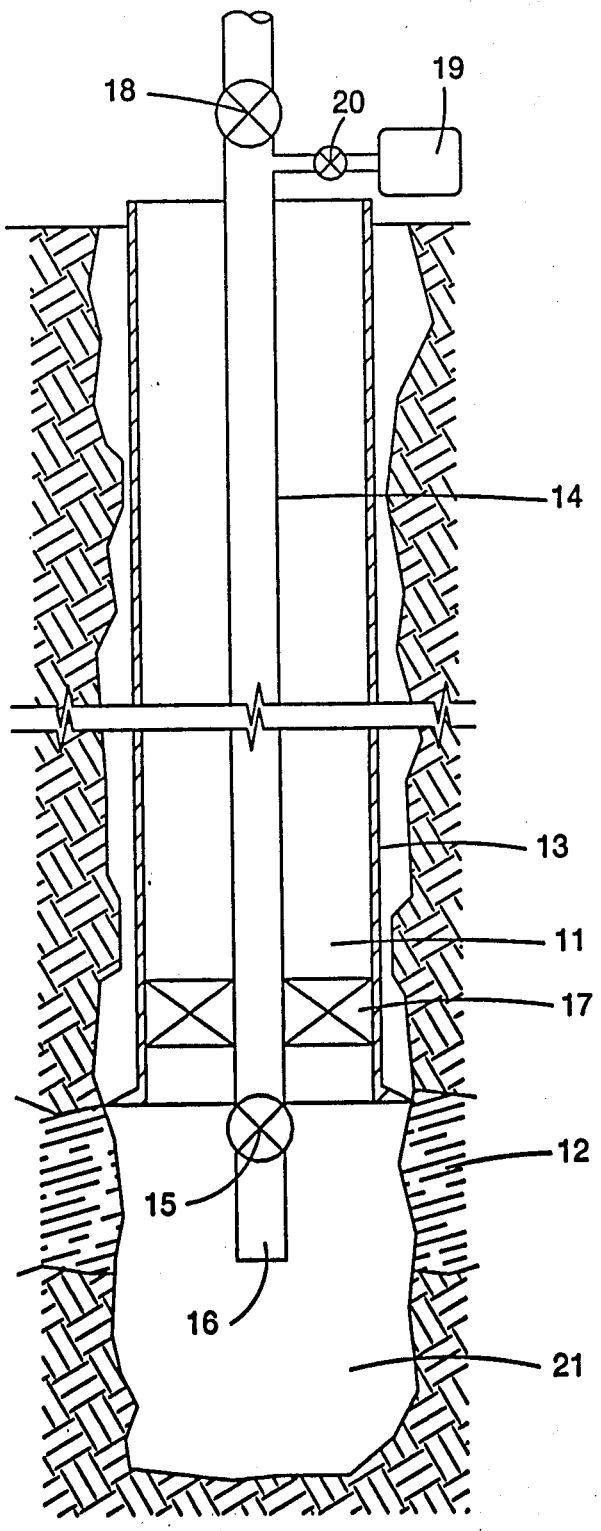
Figure 2:
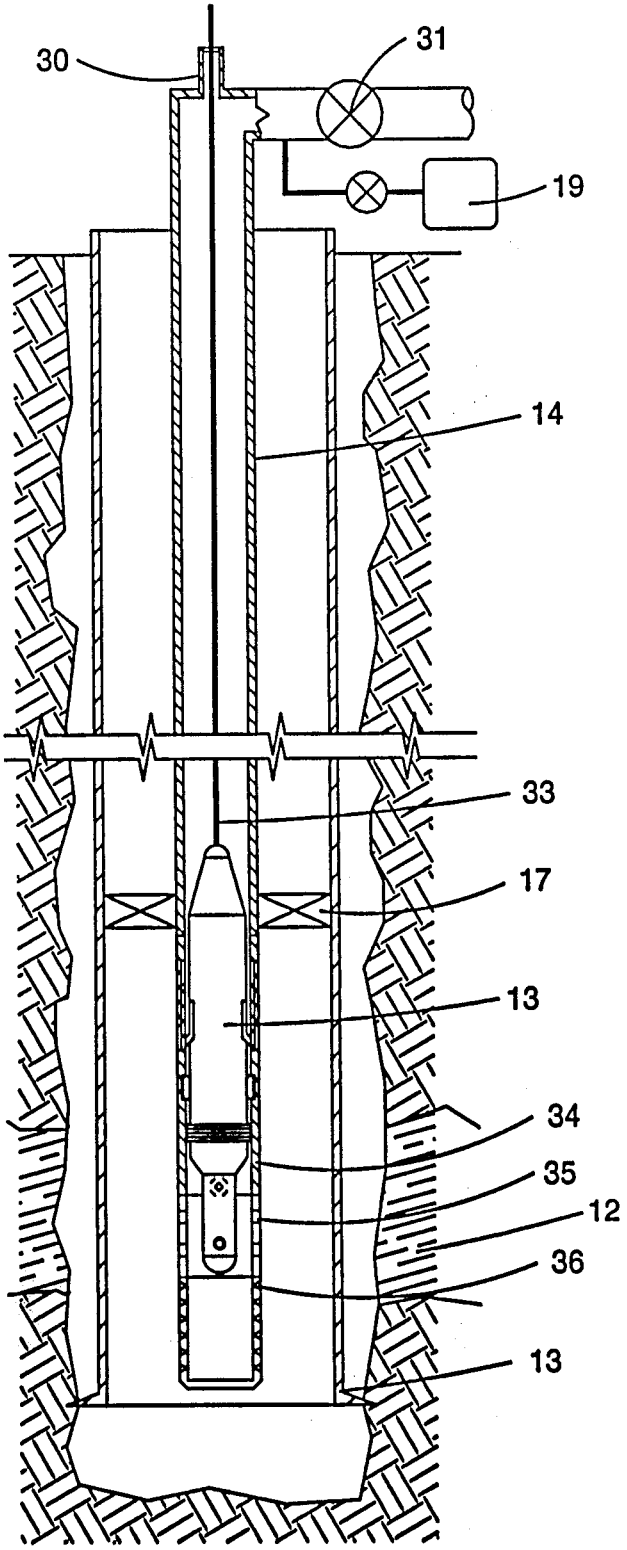

FIG. 1 and FIG. 2 show in highly diagrammatic form a cross section of the earth including a well showing two varieties of apparatus suitable for carrying out our invention.

Figure 3:
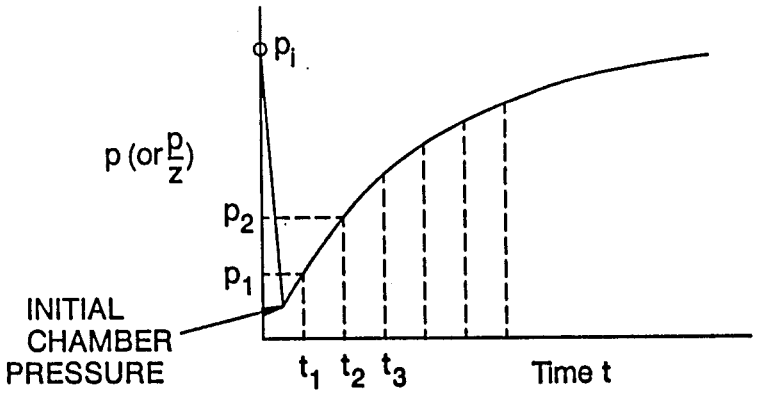
Figure 4:
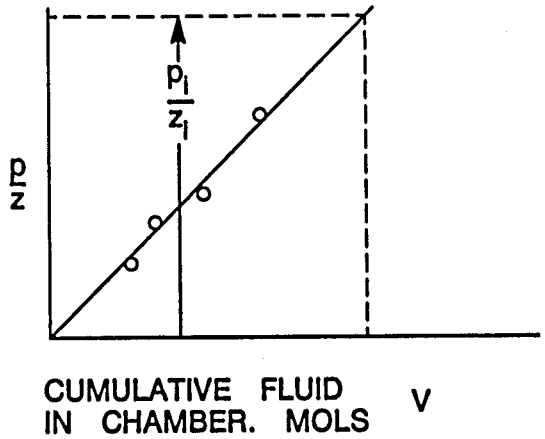
Figure 5:
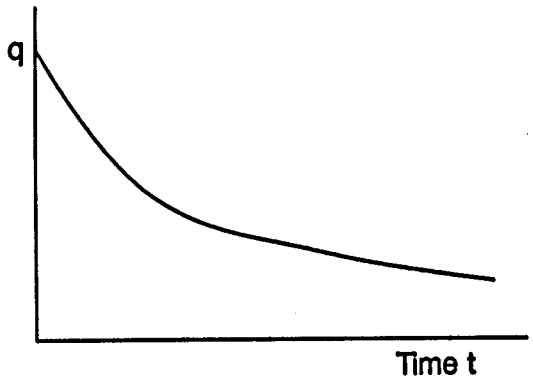

FIGS. 3, 4, and 5 show charts used in deriving data from the arrangement of apparatus shown in FIGS. 1 and 2.

SUMMARY OF THE INVENTION

The present invention is a novel, relatively rapid method of pressure transient testing in a producing well to determine (a) the formation static pressure ($p_i$), (b) the product of average formation permeability (k) times formation pay thickness (h) (sometimes called formation flow capacity), and (c) damage (or improvement) to the flow condition around the well, i.e., the skin factor.

First, a chamber of known volume $V_o$ (ordinarily a string of tubing reaching from a formation to be tested to the surface) below which is attached a pressure and temperature recording bomb, is lowered into position in the well. The pressure inside the chamber may be substantially atmospheric or other known value. A valve controllable from the surface is located at the chamber bottom. The test formation is isolated from the rest of the well by setting a packer in the annulus between chamber and well wall just above the formation top. The pressure $p_i$ obtained from the reading of the bomb after setting the packer (and preferably after a short waiting time for flows between well and formation to cease) is the initial formation pressure.

The chamber at the bottom is then opened through the valve already mentioned to permit formation fluid(s) to flow into the chamber (that is, initially at a lower pressure), determining the pressure p and the temperature T of these fluid flowing into the chamber as a function of time t. This permits calculation of the flow rate q into this closed chamber solely from knowledge of gas properties, fluid temperature, volume $V_o$, and change in pressure with time. This in turn permits calculation of the values of kh and s.

The major advantages of this testing procedure are that the total testing time is of the order of 12 to 24 hours as compared with a minimum of around 9 days or more currently required for conventional buildup tests, and that no flow rate measurement is required during this whole test. It has already been earlier mentioned that for flow rates of the order of 50 mcf/day or less, it is only with extreme difficulty that field measurements can be made. As will appear in more detail below, this new procedure allows testing of zones prior to acidizing and thereby facilitates multiple interval testing, since each zone can be tested in a short period of time. Since the completion operation of perforating must be done in any event, one aspect of this invention permits determination of initial pressure $p_i$, formation flow capacity kh, and skin factor s as a matter of consequence and for only a small cost.

DESCRIPTION OF THE PREFERRED EMBODIMENTS

In FIG. 1, a well 11 is shown drilled into a producing formation 12 in the earth, and the casing 13 has been cemented just above the producing formation 12 (open-hole completion). It is assumed that the well is full of a suitable completion fluid sufficient to produce a pressure at the face of the well which is at least equal to the initial formation pressure $p_i$ or greater. A tubing string 14 near the bottom of which is located a surface-controllable valve 15 (described in more detail later) and below which is a recording pressure and temperature bomb 16 is made up and run in the well until the packer 17 is essentially at the top of the producing formation 12. The top of this string (hereafter called a chamber of volume $V_o$) is closed by a second valve 18. Preferably near the top of volume $V_o$ there is a second means of measuring pressure 19, which usually is a deadweight tester or the like, it is connected through a valve line 20 to the chamber $V_o$.

When the apparatus has reached its ultimate location, the packer 17 is set just above the formation top of the pay formation 12 as shown in FIG. 1. After a short wait which is permitted in order to obtain equilibration of the relatively small well volume of fluid 21 located below packer 17 with the formation 12, the pressure is measured on the downhole bomb 16. This may be an Amerada pressure and temperature bomb, in which case the recording is automatically made inside the instrument as a function of time, or can, for example, be the Hewlett-Packard telemetering type bomb in which case signals are sent to the surface over a circuit (not shown) in the ordinary way of using this device. In either case, the pressure is measured. This pressure after the short delay is the pressure $p_i$, a very important bit of data for the resultant calculations. This is the initial formation pressure.

Valve 15 is then opened, which permits fluid from the formation 12 to flow into the space above valve 15, i.e., into the chamber of volume $V_o$ against a pressure which initially is known. Refer to FIG. 3, in which a chart of pressure (or p/z, to be described later) is shown plotted against time t. Pressure $p_i$ is shown as the initial pressure. The pressure then goes down essentially to initial chamber pressure when the valve 15 is opened, to establish the low point on this chart. Then the pressure gradually builds up as the volume $V_o$ of the chamber 14 is filled with more and more formation fluid. By the use of either type of pressure bomb described above (or any equivalent), it is possible to determine the pressure $p_1$ at time $t_1$, pressure $p_2$ at time $t_2$ and so on. The test time is determined by the value of p and is chosen so $p/p_i$ finally is of the order of at least $\frac{2}{3}$.

In the gas formations of relatively low permeability where this method has particular application, to at least a reasonable first approximation, the fluid from the formation flowing into the chamber 14 is gas, and can be considered to follow the universal gas law $pV=znRT$. Ordinarily the flow will occur isothermally; that is, at constant temperature T. In this case, the cumulative gas volume in the chamber under standard conditions (i.e., number of mols) varies linearly with the pressure p divided by z.

As graphically shown in FIG. 4, as time goes on the cumulative mols of fluid in the chamber 14 increases until at a time which is large, the total mols of fluid would approach closely $p_i/z_i$ as shown in this figure. The data points shown by the small circles are the values of p divided by z for various times during the flow period.

When the value of $p_i$ has been determined and the data shown in FIG. 4 are given, it is possible to calculate both (a) the formation flow capacity (kh), and also (b) the skin factor(s) which if positive shows damage to and if negative shows improvement of the flow conditions around the well. FIG. 5 shows the calculated rate of flow q occurring with time.

Since this specification is addressed to those skilled in this art, it is believed unnecessary to do more than call attention to the fact that the mathematics lying behind the determination of these quantities is found, among other places, in the following publications:

Bostic, J. N., Agarwal, R. G., and Carter, R. D., "Combined Analysis of Postfracturing Performance and Pressure Buildup Data for Evaluating an MHF Gas Well", J. Pet. Tech. (October, 1980), Vol. 268, pp. 1711–1719.

Ramey, H. J., Agarwal, R. G., and Martin, I., "Analysis of 'Slug Test' or DST Flow Period Data", J. Canadian Pet. Tech., (July/September, 1975), pp. 37–47.

One particularly advantageous type of controllable bottom valve 15 has recently been developed by Gearhart Industries, Inc. of Fort Worth in their so-called Electro Shift (ES) System. This tool was developed as a means to shut in a well downhole to reduce wellbore storage and acquire the data previously mentioned. This system in operation involves running a tubing mandrel (located below a production packer) with the tubing string. The entire system can then be set above the formation to be tested. To perform a formation pressure transient test using this tool, as described above, a special ES latching tool is run into a tubing string on a single conductor cable and latched into the tubing mandrel. In this case, the valve 18 is replaced, as shown in FIG. 2 by a stuffing box 30 and the initial pressure in the chamber 14 is controlled by means of a valve 31 on an off-shoot of the chamber 14 at the top of the well. If desired, the deadweight tester 19 may be employed at the wellhead as before. If this type of system is employed, an "ES" latching tool 32 is run on a single conductor wireline 33 until the latching tool is inside the "ES" tubing mandrel 34, which is just above a shock sub 35. This in turn supports a perforating gun 36 at the bottom of the tubing string 14.

By an electromechanical mechanism, a seal is effected allowing the tubing mandrel 34 which contains a sliding sleeve to be controlled at the surface to either open or close it as desired. The drawdown period of the flow test at the well is accomplished by opening the sliding sleeve of the tubing mandrel 34 using the latching tool 32 for a period, followed by formation buildup accomplished by closure of the tubing mandrel 34 and a subsequent waiting period.

In this FIG. 2, the perforating gun 36 is chosen of correct size to perforate the productive interval of formation 12 with the proper number of perforations. The tail pipe and shock sub 35 protects the ES tubing mandrel 34 from the perforating gun detonations.

In this case, the method of operation is to run the above tubing and tools into a well with a lowered pressure in chamber 14. The packer 17 is set at the appropriate location, using a gamma ray correlation log for example. This places the perforating gun adjacent to the interval of interest. The wireline 33 on which is suspended the assembly 32 consisting of the ES shifting latch tool and pressure bomb is run and enters into the ES tubing mandrel 34. After a check by the operator to insure that the tubing mandrel is closed, a pressure reading is obtained to assure that there are no pressure leaks. The perforating gun 36 is then fired electrically from the surface. Approximately 30 seconds to a minute waiting time is employed for the impact due to the detonation to dissipate. Additional time is then taken to measure the pressure below the packer, using the pressure bomb at the lower end of tool 32, to determine the initial reservoir pressure $p_i$. Then the tool 32 is manipulated to permit the ES tubing mandrel 34 to be opened and the formation fluids from behind the casing 13 allowed to fill the closed chamber $V_o$ 14. Pressures and temperatures are measured downhole by tool 32 and preferably additionally on the surface (by unit 19) to yield the necessary data for the buildup of the pressure versus time as shown on FIG. 3. This permits the analysis of the rate of pressure buildup in this limited volume wellbore transient test.

It is understood that there can be substantial variations and modifications of the basic method which has been described above. These will be understood to fall within the definitions of the appended claims. It is to be noted that the major advantages of this testing procedure involve the following points: the total testing time is of the order of 12 to 24 hours, as compared with the 9 days or more currently required for a conventional prefrac buildup test. This short time interval for the testing readily insures that the packer can be deflated and the entire testing chamber retrieved. Low rate measurement can occur during this test, with no need for an orifice meter. Finally, the new procedure allows testing of zones prior to acidizing and should facilitate interval testing since each zone can be separately tested in a relatively short period of time. The operation of perforating must be done in any event. This invention allows determination of initial pressure, $p_i$, formation flow capacity kh, and skin factor, s, almost as a matter of consequence and for only a small cost.

What we claim is:

1. A method of flow testing a producing low-permeability gas-formation through a well comprising:
   (a) placing an instrument adjacent the formation;
   (b) placing test chamber apparatus in the well;
   (c) sealing the space between said test chamber apparatus and the well and measuring the pressure and temperature within the well with said instrument;
   (d) allowing formation fluids to enter said test chamber apparatus; and
   (e) measuring the pressure and temperature within the well as a function of time by said instrument as the pressure within said test chamber apparatus increases.

2. A method of flow testing a low-permeability gas-producing formation through a well comprising:
   (a) placing an instrument adjacent the formation;
   (b) placing perforating means opposite the formation;
   (c) placing test chamber apparatus in the well;
   (d) sealing the space between said test chamber apparatus and the well;
   (e) actuating said perforating means to permit flow of formation fluid into the well;
   (f) measuring the pressure and temperature within the well with said instrument;
   (g) allowing formation fluids to enter said test chamber apparatus; and
   (h) measuring the pressure and temperature within the well as a function of time by said instrument as the pressure within said test chamber apparatus increases.

3. The method of claims 1 or 2 wherein said instrument is a recording pressure and temperature bomb.

4. The method of claims 1 or 2 wherein said test chamber apparatus is provided with a valve controllable from the surface.

5. The method of claims 1 or 2 wherein the pressure within said test chamber is lower than that of said formation.

6. The method of claims 1 or 2 wherein the space between said test chamber and the well is sealed by a gravel packer.

7. The method of claim 4 wherein formation fluids enter said test chamber by opening said valve, whereby fluids from said formation flow into said test chamber under variable pressures.

8. The method of claim 1 wherein after allowing formation fluids to enter said test chamber the pressure and temperature are measured as a function of time for a substantial period of time during which the pressure in said test chamber rises substantially above its lowest level.

9. An improved method of flow testing a low-permeability gas-producing formation in a well including the following steps:
   (a) lowering into said well a recording pressure and temperature instrument to measure pressure and temperature as functions of time adjacent to the face of said producing formation in said well,
   (b) lowering into said well a test chamber closed at the bottom by a valve controllable from the surface, with the pressure in said chamber substantially lower than that of said formation,
   (c) sealing the space between said chamber and said well near the top of said formation, (d) measuring with said recording pressure and temperature instrument the pressure and temperature shortly after said sealing, (e) opening said controllable valve, whereby fluids from said formation flow into said test chamber under variable pressures, and (f) measuring with said recording pressure and temperature instrument the pressure and temperature as a function of time for a substantial period of time during which the pressure in said test chamber rises substantially above its lowest value, whereby the flow capacity and the skin factor of said formation can be calculated.

10. A method in accordance with claim 9, in which said formation is behind the well casing, including the steps of (g) lowering a gun perforator or the like to a position opposite said formation prior to step (b), and (h) actuating said perforator after step (c) and before step (d), to permit flow of formation fluid into said well.

11. A method in accordance with claim 10 in which said gun perforator is connected at the bottom of said test chamber.

* * * * *